US010516216B2

(12) United States Patent
Harless et al.

(10) Patent No.: US 10,516,216 B2
(45) Date of Patent: Dec. 24, 2019

(54) DEPLOYABLE REFLECTOR ANTENNA SYSTEM

(71) Applicant: Eagle Technology, LLC, Melbourne, FL (US)

(72) Inventors: Richard I. Harless, Melbourne, FL (US); Joshuo Feys, Rockledge, FL (US)

(73) Assignee: Eagle Technology, LLC, Melbourne, FL (US)

( * ) Notice: Subject to any disclaimer, the term of this patent is extended or adjusted under 35 U.S.C. 154(b) by 184 days.

(21) Appl. No.: 15/870,063

(22) Filed: Jan. 12, 2018

(65) Prior Publication Data

US 2019/0221944 A1 Jul. 18, 2019

(51) Int. Cl.

| | |
|---|---|
| ***H01Q 15/16*** | (2006.01) |
| ***H01Q 15/20*** | (2006.01) |
| ***H01Q 7/02*** | (2006.01) |
| *H01Q 1/28* | (2006.01) |

(52) U.S. Cl.
CPC ..... *H01Q 15/161* (2013.01); *H01Q 7/02* (2013.01); *H01Q 1/28* (2013.01)

(58) Field of Classification Search
CPC ..... H01Q 15/14; H01Q 15/16; H01Q 15/20
See application file for complete search history.

(56) References Cited

U.S. PATENT DOCUMENTS 3,397,399 A * 8/1968 Carman ..... H01Q 15/162 343/915
4,030,102 A 6/1977 Kaplan et al.
4,899,167 A * 2/1990 Westphal ..... H01Q 15/162 343/912
4,989,015 A 1/1991 Chang
5,579,021 A 11/1996 Lee
5,666,128 A 9/1997 Murray et al.
5,714,179 A 2/1998 Goodridge et al.
5,818,395 A 10/1998 Wolcott et al.
5,864,324 A 1/1999 Acker et al.
5,870,060 A 2/1999 Chen et al.
5,912,741 A 6/1999 Carter et al.
5,947,590 A 9/1999 Meuse et al.
5,969,695 A 10/1999 Bassily et al.
5,990,851 A * 11/1999 Henderson ..... H01Q 1/081 343/840
6,018,328 A 1/2000 Nolan et al.
6,028,570 A 2/2000 Gilger et al.
(Continued)

*Primary Examiner* — Tho G Phan

(74) *Attorney, Agent, or Firm* — Fox Rothschild LLP; Robert J. Sacco; Carol E. Thorstad-Forsyth

(57) ABSTRACT

Reflector antenna system includes a hoop assembly comprising a plurality of link elements which are rigid and extend between a plurality of hinge members, the hoop assembly expandable between a collapsed condition where the link elements are substantially parallel to one another and an expanded condition wherein the link elements define a circumferential hoop around a central axis. The hoop assembly defines a plurality of N rectangular sides, each comprised of an X-member including first and a second link element in a crossed configuration. A plurality of tension elements extend around the periphery of the side and apply tension between opposing ends of the first and second link elements in directions aligned with the top, bottom and two opposing sides.

23 Claims, 10 Drawing Sheets

(56) References Cited

U.S. PATENT DOCUMENTS 6,043,425 A 3/2000 Assad
6,081,244 A 6/2000 Peck
6,094,175 A 7/2000 Alessi et al.
6,104,358 A 8/2000 Parker et al.
6,133,570 A 10/2000 Schimert et al.
6,137,454 A 10/2000 Peck
6,154,522 A 11/2000 Cumings
6,172,655 B1 1/2001 Volman
6,189,835 B1 2/2001 Kaufman
6,191,757 B1 2/2001 Bassily et al.
6,208,317 B1 3/2001 Taylor et al.
6,214,144 B1 4/2001 Bassily et al.
6,219,003 B1 4/2001 Chandler
6,219,009 B1 * 4/2001 Shipley ..... H01Q 1/288 343/912
6,243,053 B1 6/2001 Shtarkman
6,278,416 B1 8/2001 Harless
6,285,332 B1 9/2001 Chandler
6,290,180 B1 9/2001 Browall et al.
6,297,511 B1 10/2001 Syllaios et al.
6,307,194 B1 10/2001 Fitzgibbons et al.
6,313,811 B1 11/2001 Harless
6,366,257 B1 4/2002 Ramanujam et al.
6,377,183 B1 4/2002 Baker et al.
6,445,343 B1 9/2002 Pietrusiak
6,489,929 B1 12/2002 Duchesne et al.
6,515,636 B2 2/2003 Munder et al.
6,542,129 B1 4/2003 Bien et al.
6,542,132 B2 4/2003 Stern
6,570,528 B1 5/2003 Rao et al.
6,602,607 B2 8/2003 Rengakuji et al.
6,611,238 B1 8/2003 Santoru et al.
6,618,025 B2 9/2003 Harless
6,621,459 B2 9/2003 Webb et al.
6,621,461 B1 9/2003 Ramanujam et al.
6,642,905 B2 11/2003 Bien et al.
6,747,608 B2 6/2004 Wu
6,768,468 B2 7/2004 Crouch et al.
6,775,046 B2 8/2004 Hill et al.
6,828,949 B2 * 12/2004 Harless ..... H01Q 15/161 343/912
6,859,188 B1 2/2005 Matthews et al.
6,882,323 B2 4/2005 Peebles et al.
6,919,863 B2 7/2005 Kawahara et al.
6,930,654 B2 8/2005 Schmid et al.
6,937,203 B2 8/2005 Rao et al.
6,975,282 B2 12/2005 Kaufman et al.
7,009,578 B2 3/2006 Nolan et al.
7,024,158 B2 4/2006 Wiswell
7,034,771 B2 4/2006 Rao et al.
7,104,506 B1 9/2006 Goodzeit et al.
7,110,716 B2 9/2006 Rao et al.
7,119,480 B2 10/2006 Guy
7,126,477 B2 10/2006 Gallivan et al.
7,129,903 B2 10/2006 Desargant et al.
7,216,995 B2 5/2007 Harada et al.
7,242,904 B2 7/2007 Rao et al.
7,270,301 B2 9/2007 Maurel
7,345,653 B2 3/2008 Nolan et al.
7,379,191 B2 5/2008 Brooks
7,382,743 B1 6/2008 Rao et al.
7,394,436 B2 7/2008 Rao et al.
7,443,573 B2 10/2008 Brown
7,490,538 B2 2/2009 Lowell et al.
7,494,255 B2 2/2009 Bryan et al.
7,498,549 B2 3/2009 Gallivan et al.
7,570,226 B2 8/2009 Bassily
7,595,769 B2 9/2009 Bassily
7,675,456 B2 3/2010 Karam et al.
7,686,255 B2 3/2010 Harris
7,705,796 B2 4/2010 Park
7,710,340 B2 5/2010 Rao et al.
7,714,792 B2 5/2010 Leveque et al.
7,715,091 B2 5/2010 Brown
7,721,426 B2 5/2010 Desagulier et al.
7,726,015 B2 6/2010 Desagulier et al.
7,730,819 B2 6/2010 Lowell et al.
7,737,903 B1 6/2010 Rao et al.
7,751,779 B2 7/2010 Ho et al.
7,784,390 B1 8/2010 Lowell et al.
7,804,055 B2 9/2010 Backes
7,839,353 B2 11/2010 Bassily
7,868,840 B2 1/2011 Rao et al.
7,920,100 B2 4/2011 Brown et al.
8,253,620 B2 8/2012 Wise et al.
8,269,202 B2 9/2012 Backes
8,315,557 B1 11/2012 Rao et al.
8,317,960 B2 11/2012 Montesano Benito et al.
8,354,956 B2 1/2013 Matyas et al.
8,462,067 B2 6/2013 Maxwell-Cox
8,481,858 B2 7/2013 Desagulier
8,568,100 B2 10/2013 Muylaert et al.
8,587,227 B2 11/2013 Koch
8,659,493 B2 2/2014 Bosshard et al.
8,760,358 B2 6/2014 Bouguereau et al.
8,781,794 B2 7/2014 Harrison et al.
8,797,663 B1 8/2014 Bouckaert
8,810,806 B2 8/2014 Barbier et al.
8,878,745 B2 11/2014 Navarre et al.
8,905,587 B1 12/2014 Bouckaert
8,960,929 B2 2/2015 Devilliers et al.
9,099,595 B2 8/2015 King et al.
9,112,281 B2 8/2015 Bresciani et al.
9,190,716 B2 11/2015 Robson et al.
9,281,569 B2 3/2016 Taylor et al.
9,293,820 B2 3/2016 Koduru et al.
9,318,808 B1 4/2016 Weaver et al.
9,337,544 B2 5/2016 Theunissen et al.
9,381,581 B1 7/2016 Zaman et al.
9,429,300 B2 8/2016 Bouckaert
9,458,987 B2 10/2016 Jungwirth et al.
9,484,636 B2 11/2016 Mobrem
9,496,621 B2 11/2016 Meschini et al.
9,608,333 B1 * 3/2017 Toledo ..... H01Q 15/161

* cited by examiner

DEPLOYABLE REFLECTOR ANTENNA SYSTEM

BACKGROUND

Statement of the Technical Field

This document relates to compact antenna system structures, and more particularly, to a compact deployable antenna reflector structure.

Description of the Related Art

Various conventional antenna structures exist that include a reflector for directing energy into a desired pattern. One such conventional antenna structure is a radial rib reflector design comprising a plurality of reflector ribs joined together at a common cylindrical shaped hub. The reflector ribs provide structural support to a flexible antenna reflector surface attached thereto. A plurality of cords, wires, guidelines, or other tensile members couple the flexible antenna reflector surface to the reflector ribs. The wires or guidelines define and maintain the shape of the flexible antenna reflector surface. The radial rib reflector is collapsible so that it can be transitioned from a deployed position to a stowed position. In the deployed position, the radial rib reflector has a generally parabolic shape. In the stowed position, the reflector ribs are folded up against each other. As a result, the antenna reflector has a stowed height approximately equal to the reflector's radius.

Another conventional antenna structure is a folding rib reflector having a similar design to the radial rib reflector design described above. However, the reflector ribs include a first rib tube and second rib tube joined together by a common joint. In the stowed position, the first rib tubes are folded up against the second rib tubes. As such, the antenna reflector has a stowed height that is approximately half the stowed height of the radial rib reflector design. However, the stowed diameter of the folding rib reflector may be larger than the stowed diameter of the radial rib reflector design.

Another type of configuration is a hoop reflector where the reflector surface is attached to a circular hoop. In a hoop-type reflector, the hoop structure must have a certain amount of stiffness to prevent the hoop from warping. Typical of this design is U.S. Pat. No. 5,680,145. In this patent, the hoop consists of two rings, an upper and a lower. Both rings are made up of tube elements. As such, the single tube elements provide minimal bending stiffness, or ring stiffness, about the longitudinal axis of symmetry defined as the direction perpendicular to the circle defining the perimeter of the hoop. The limited ring stiffness allows the hoop to become non-circular and is easily deformed into an oval shape. Other hoop designs provide significant ring stiffness by creating a toroidal hoop with a triangular configuration of members. For example, such an arrangement is disclosed in U.S. Pat. No. 6,313,811. To shape the reflector into a parabolic surface, the hoop must also have a deployed thickness perpendicular to the plane defined by the perimeter of the hoop. The thickness of the hoop is measured in the direction of a central axis of the hoop when deployed. Moreover, this thickness must generally be greater than the depth of the parabolic surface in order to achieve a desired parabolic shape. The required out of plane thickness of the hoop and the need for bending stiffness can make it challenging to design a hoop structure which, when stowed, is sufficiently compact in length along the longitudinal direction defined by the hoop central axis. For example, a conventional hoop system having a sufficiently rigid hoop structure with a deployed thickness H can, when collapsed for stowage aboard a spacecraft, have an elongated length along the hoop center axis equal to 2H.

SUMMARY

This document concerns a reflector antenna system. The system includes a hoop assembly which is comprised of a plurality of link elements which are rigid and extend between a plurality of hinge members. The hoop assembly is configured to expand between a collapsed condition wherein the link elements extend substantially parallel to one another and an expanded condition wherein the link elements define a circumferential hoop around a central axis. A reflector surface of the antenna system is comprised of a collapsible web and secured to the hoop assembly such that when the hoop assembly is in the expanded condition, the reflector surface is expanded to a shape that is configured to concentrate RF energy in a desired pattern.

The hoop assembly in the expanded condition is defined by a plurality of N sides, each defining a rectangle, including a top, a bottom, and two opposing edges aligned with the central axis. The N sides are disposed edge to edge circumferentially around a periphery of the hoop assembly such that each opposing edge extends substantially the full axial depth of the expanded hoop assembly in a direction aligned with the hoop central axis.

Each of the N sides is comprised of an X-member. Each X-member is comprised of a plurality of the link elements. These link elements include a first and a second link element respectively disposed on opposing diagonals of the rectangle in a crossed configuration. A pivot member is connected at a medial pivot point of the first and second link elements. The pivot member facilitates pivot motion of the first link element relative to the second link element on a pivot axis when the hoop assembly transitions between the collapsed condition and the expanded condition. The hinge members connect adjoining ones of the X-members associated with adjacent sides at the top and bottom corners associated with each edge.

The hoop assembly also includes at least one top cord which extends along the top of the side between top ends of the first and second link elements, and at least one bottom cord which extends along the bottom of the side between bottom ends of the first and second link elements. Each of the top cord and the bottom cord are exclusively tension elements. Further, first and second edge tension elements extend respectively along the two opposing edges of the side. At least one deployment cable provides a force needed to transition the hoop assembly from the collapsed condition to the expanded condition by reducing a length of each opposing edge.

In the system described herein, each of the first and second link elements includes a top end which extends to a top corner of the rectangle defined by the side, and a bottom end which extends to a bottom corner of the rectangle defined by the side. The first link element of each X-member is connected at the top end to the second link element of a first one of the X-members associated with a first adjacent side. The first link element is also connected at a bottom end to the second link element of a second one of the X-members associated with a second adjacent side.

The second link element is comprised of a plurality of elongated structural members which extend in parallel respectively on an inner and outer side of the first link element. The pivot member pivotally connects each of the plurality of elongated structural members to the first link element. The plurality of elongated structural members which comprise the second link element are connected to a top hinge at a top end of the second link element, and connected to a bottom hinge at a bottom end of the second link element.

The deployment cable extends along a length of each of the edge tension elements, and diagonally along the length of the first link element of the side. Top and bottom cord guide elements are respectively disposed at the top and bottom ends of the first link element. These top and bottom cord guide elements are configured to transition an alignment of the deployment cable from directions aligned with the opposing edges of each side, to a diagonal direction aligned with the first link element. At least one latching element is configured to latch the X-members in a fixed pivot position after the hoop assembly is in the expanded condition. Consequently, a force applied to the first link element by the deployment cable can be reduced while maintaining the hoop assembly in the expanded condition.

The reflector antenna system also includes at least one actuator configured to vary a length of the opposing edges of the side by controlling the extended length of the deployment cable extending around a periphery of the hoop assembly. A resistance mechanism is advantageously provided to resist the transition of the hoop assembly from the collapsed condition to the expanded condition. The force generated by the resistance mechanism serves to control the deployment rate and position of hoop as it transitions from the collapsed to the expanded condition.

BRIEF DESCRIPTION OF THE DRAWINGS

This disclosure is facilitated by reference to the following drawing figures, in which like numerals represent like items throughout the figures, and in which.

DETAILED DESCRIPTION

Figure 1:
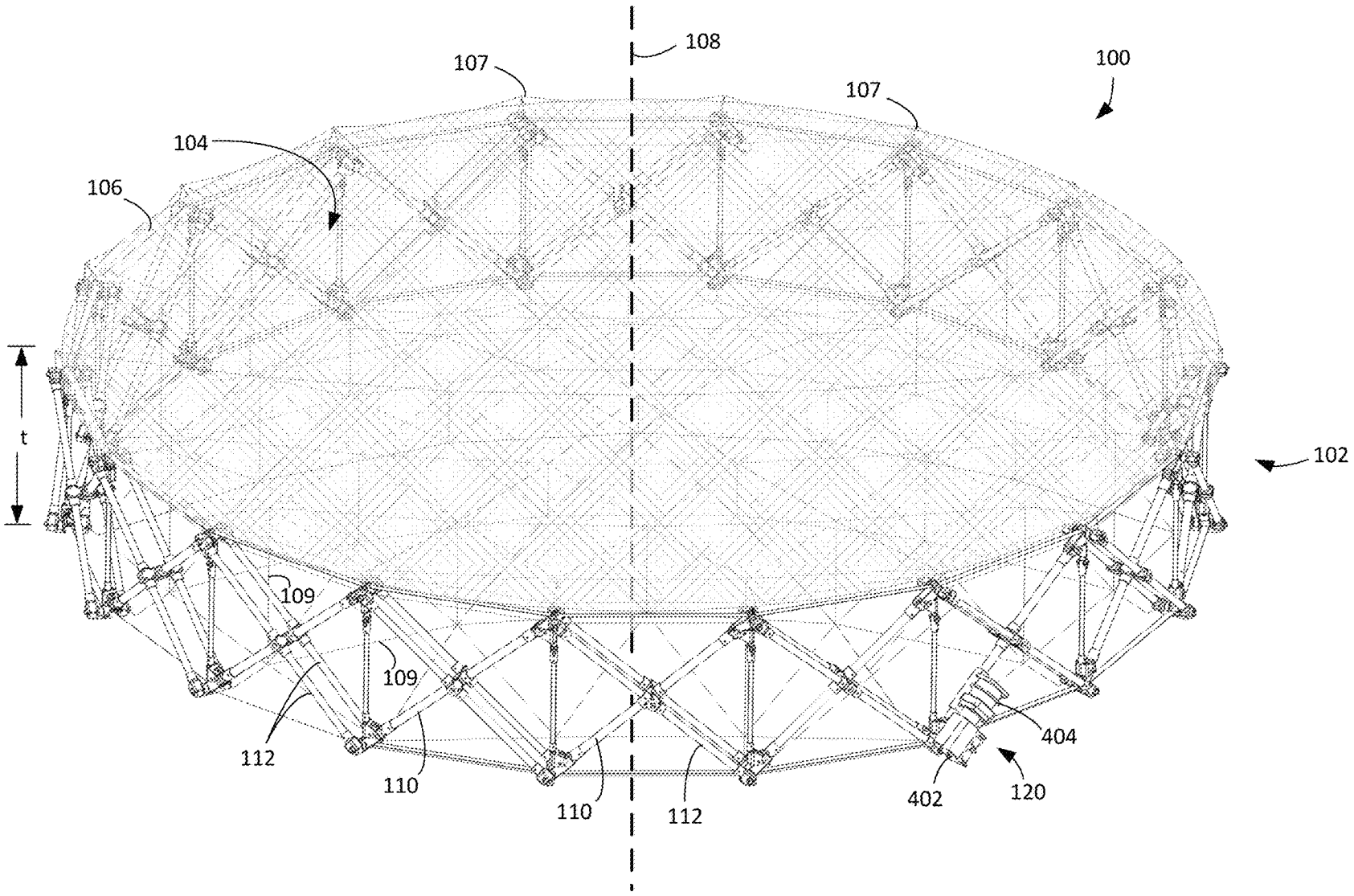
FIG. 1 is a perspective view of a deployed reflector antenna system which is useful for understanding the disclosure.

It will be readily understood that the components of the systems and/or methods as generally described herein and illustrated in the appended figures could be arranged and designed in a wide variety of different configurations. Thus, the following more detailed description, as represented in the figures, is not intended to limit the scope of the present disclosure, but is merely representative of certain implementations in various different scenarios. While the various aspects are presented in the drawings, the drawings are not necessarily drawn to scale unless specifically indicated.

The required out of plane thickness of a hoop-type reflector antenna, and the need for a minimal level of bending stiffness, can make it challenging to design a suitable hoop structure. For example, it can be difficult to design such an antenna that, when stowed, demonstrates sufficient compaction in length in the longitudinal direction defined by the hoop central axis. The hoop-type reflector antenna disclosed herein is rigid and lightweight. But when collapsed for stowage (e.g. stowage aboard a spacecraft) the antenna structure will have an elongated length along a hoop center axis which is 1.4 t, where the distance t is a thickness of the antenna structure along the longitudinal hoop center axis when the reflector is in a deployed condition. This represents a significant improvement over conventional designs which when collapsed for stowage have an elongated length along the hoop center axis equal to 2 t.

A deployable reflector system (DRS) 100 will now be described with reference to FIGS. 1-4. The DRS 100 is comprised of a hoop assembly 102. The hoop assembly 102 defines an interior space 104 for a deployable reflector surface 106. The hoop assembly 102 is configured to so that it can deploy to an expanded condition shown in FIGS. 1-3, and can collapse into a stowed condition shown in FIG. 4. To enhance the clarity of this disclosure, the reflector surface is not shown in FIGS. 2-4.

In the stowed condition, the hoop assembly can be sufficiently reduced in size such that it may fit within a compact space (e.g., a compartment of a spacecraft or on the side of a spacecraft). The hoop assembly 102 can have various configurations and sizes depending on the system requirements. In some scenarios the hoop assembly 102 can define a circular structure as shown in FIG. 1 and in other scenarios the hoop assembly can define an elliptical structure. Advantageously, the hoop assembly 102 can be configured to be a self-deploying system. As will be described in more detail hereinafter, the configuration of the hoop assembly 102 allows for a DRS which has a smaller stowed volume as compared to conventional deployable antenna designs of similar aperture size. A further advantage of the system disclosed herein is that it offers reduced weight as compared to such conventional designs.

The hoop assembly 102 is comprised of a plurality of link elements which are disposed about a central, longitudinal axis 108. The link elements can comprise two basic types which are sometimes referred to herein as a first link element 110, and a second link element 112. The link elements are elongated rigid structures which extend between hinge members 114, 116 disposed on opposing ends of the link elements. For example, in some scenarios the link elements can be comprised of elongated rigid tubular structures formed of a rigid lightweight material. Exemplary materials which can be used for this purpose include metallic or a Carbon Fiber Reinforced Polymer [or Plastic] (CFRP) composite material.

Figure 4:
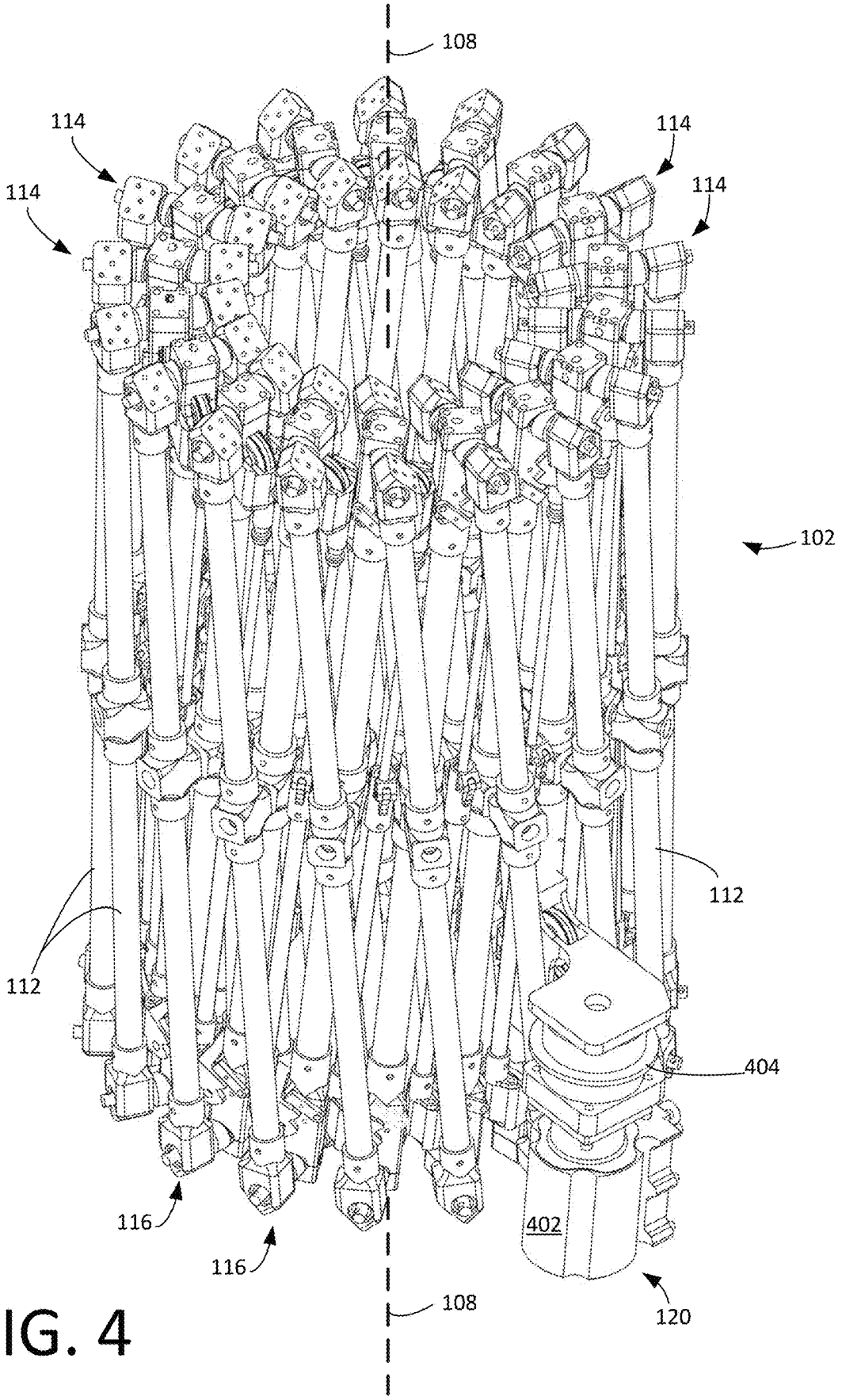
FIG. 4 is a perspective view of the hoop assembly in a collapsed or stowed condition.

As may be observed in FIG. 4, the arrangement of the hoop assembly is such that the hoop can have a collapsed condition wherein the first and second link elements extend substantially parallel to each other, and an expanded condition wherein the link elements define a circumferential hoop around a central axis. In some scenarios, the substantially parallel condition referred to herein can include a condition in which the axial length of the first and second link elements each form an angle of less than about 5 to 10 degrees relative to the central axis 108 of the hoop assembly. Further, it can be observed by comparing FIG. 2 and FIG. 4 that a circumference defined by the hoop assembly 102 in the expanded condition can be much greater as compared to the circumference defined by the hoop in the collapsed condition.

The reflector surface 106 is advantageously formed of a thin highly flexible sheet or web material. The reflector surface is likewise comprised of a material which is highly reflective of radio frequency signals. For example, in some scenarios the reflector surface can be comprised of a reflective film or a conductive metal mesh. Reflective films and conductive metal meshes used for this purpose are well-known in the art and therefore will not be described here in detail. However, due to their highly flexible nature, these materials are inherently collapsible, such that they can be compactly stowed when the hoop is in the collapsed condition. For example, the mesh material in some scenarios can be stored in a collapsed or folded condition within the circumference of the hoop assembly when folded or collapsed for stowage. The conductive mesh material is advantageously secured at attachment points 107 along its periphery to the hoop assembly 102. The mesh material is also attached at various locations to shaping/support cords 109 disposed within the periphery of the hoop assembly. Consequently, when the hoop assembly is in the expanded condition, the reflector surface is expanded to a shape that is intended to concentrate RF energy in a desired pattern. For example, the reflector surface can be controlled so as to form a parabolic surface when the hoop assembly is in the expanded or deployed condition. To enhance the clarity of the disclosure herein, the reflector surface 106 and the shaping/support cords 109 are not shown in FIGS. 2-4.

It may be noted that in order to shape the reflector 106 into a parabolic surface (or other reflecting surface shape), the hoop assembly 102 will necessarily need to have a thickness t which extends in the longitudinal direction aligned with the central axis 108. As such, the hoop assembly 102 will include structural elements which extend some predetermined distance out of a plane defined by the peripheral edge of the reflector surface. This distance is usually greater than the depth of the reflector as measured along the axis 108. It will be appreciated the hoop assembly as described herein must also have a degree of bending stiffness to allow the reflector to conform to the required shape. For a system using symmetric optics where RF energy is focused along the longitudinal axis of the reflector 108, the structure 102 will be circular when deployed. For systems requiring an 'offset' configuration where the RF energy is focused on a line parallel to the longitudinal axis 108 but located outside the perimeter of the hoop, the structure 102 is elliptical in shape.

Figure 3:
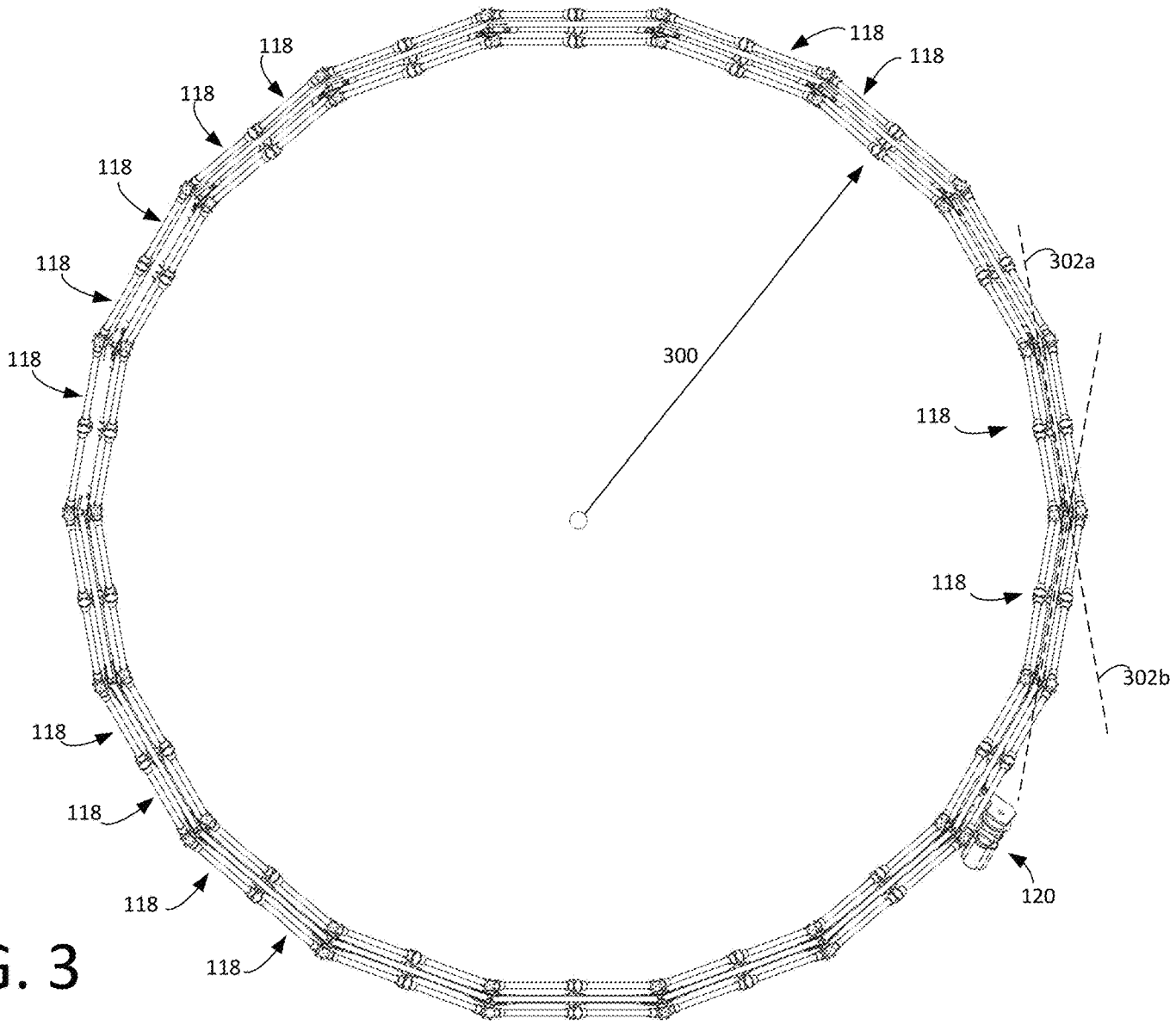
FIG. 3 is a top view of the deployed hoop assembly.

Referring now to FIG. 3 it can be observed that when the hoop assembly 102 is in the expanded condition, the arrangement of the link elements 110, 112 is such that the assembly will define a plurality of N sides 118, where N is an integer. The actual value of N can vary depending on a various design considerations. Usually for reasons of symmetry, it is advantageous to select a value for N that is evenly divisible by 2. Still, divisibility by 2 is not essential and in some scenarios it can be advantageous to select N so that it is divisible by other values. For example, depending upon the geometry of the cord or wire network that supports and forms the surface geometry, the number of sides may need to be divisible by 6. Theoretically, a minimum of 3 sides are required to define a 3-dimensional shape, although the resulting shape may not be practical in supporting a RF surface. But, an important consideration for purposes of selecting the number of sides, N, is the length of the stowed package. In general, as the number of sides is increased, the stowed length in a direction along the central axis of the antenna system will be decreased. However, as the number of sides increases, likewise the stowed diameter of the package will increase. Thus, the number of sides can be advantageously selected by a designer for each application to optimize packaging and weight.

Figure 5:
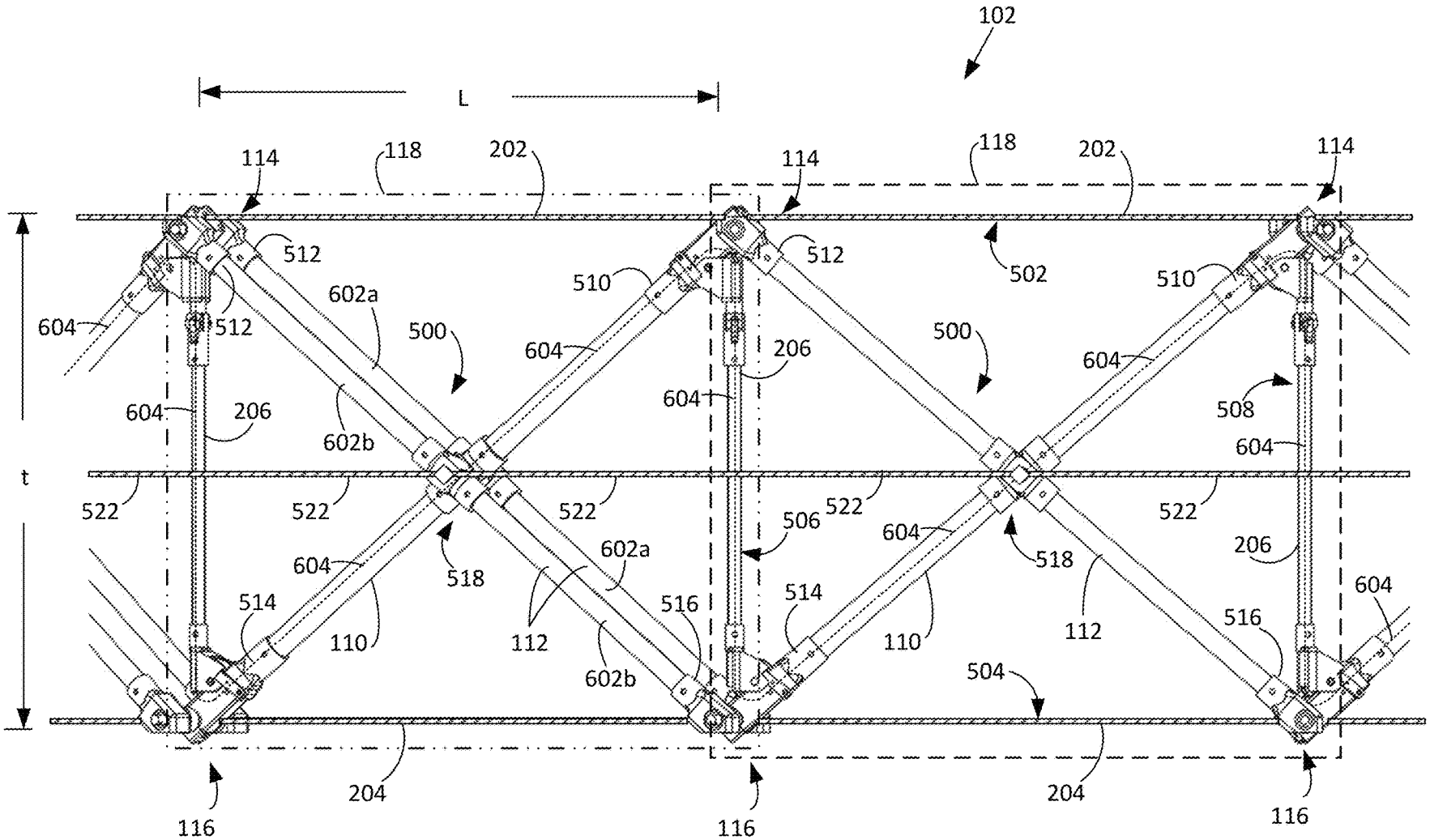
FIG. 5 is a side view of a portion of the deployed hoop assembly which is enlarged to show certain details.

As shown in FIG. 5, the arrangement of link elements allows each of the N sides 118 to be understood as defining a rectangle or rectangular shape. As such, the sides 118 are also sometimes referred to herein as rectangular sides. Each rectangular side is comprised of a top 502, a bottom 504 and two opposing, vertical edges 506, 508 which generally define the outer periphery or edges of each rectangular side. As used herein, the word "vertical" is used to indicate a direction which is generally aligned with the direction of the central, longitudinal axis 108.

In some scenarios, the top and bottom edges 502, 504 can be aligned with a top cord 202 and a bottom cord 204 when the hoop assembly is in a deployed condition. Likewise, the two opposing vertical edges 506, 508 can be aligned with aligned with side edge tension elements 206. Such a scenario is illustrated in FIG. 3 where the elongated length of the top and bottom cords correspond to the top and bottom edges 502, 504, and the vertical side edges correspond to the side tension elements 506, 508. But in some scenarios, these various edges may not correspond to these structural elements and may instead correspond to imaginary lines drawn between hinge members 114, 116 disposed on opposing ends of the link elements. In some scenarios, the top, bottom and two opposing edges can all be of the same length such that the rectangular shape is a square. However, in other scenarios the rectangular side can have a top and bottom which are of a length different from the two vertical edges.

As may be observed in FIGS. 3 and 5 the N sides are disposed adjacently, edge to edge, and extend circumferentially to define a periphery of the hoop assembly 102. Further, the opposing edges 506, 508 of each side can advantageously extend substantially along the full axial depth or thickness t of the hoop assembly 102 in a direction aligned with the hoop longitudinal axis 108. As such, a top 502 of each side will be substantially aligned along a top plane of the hoop assembly which extends in directions orthogonal to the hoop longitudinal axis. Similarly, a bottom edge 504 of each side will be substantially aligned along a bottom plane of the hoop assembly 102 which extends in directions orthogonal to the hoop longitudinal axis. When the hoop assembly is expanded, the bottom plane is spaced a distance t from the top plane.

Each of the N sides is defined in part by an X-member 500 which is comprised of a first and second link element 110, 112. As shown in FIG. 5, the first and second link elements are disposed in a crossed configuration. More particularly, the first and second link elements can be respectively disposed on opposing diagonals of the rectangle which defines each side. As such, each of the first and second link elements 110, 112 can respectively include a top end 510, 512 which extends substantially to a top corner defined by the top 502 and one side 506, 508 of the side. Each of the first and second link elements can also respectively include a bottom end 514, 516 which extends substantially to a bottom corner of the rectangle defined by the bottom 504 and sides 506, 508 of the side.

A pivot member 518 is connected at a pivot point of the first and second link elements. The pivot point is advantageously located intermediate of the two opposing ends of each link element. For example, the pivot point is advantageously disposed at approximately equal distance from the opposing ends of the first link element, and at approximately equal distance from the opposing ends of the second link element. As such, the pivot point can located approximately at a midpoint of each element.

Figure 6:
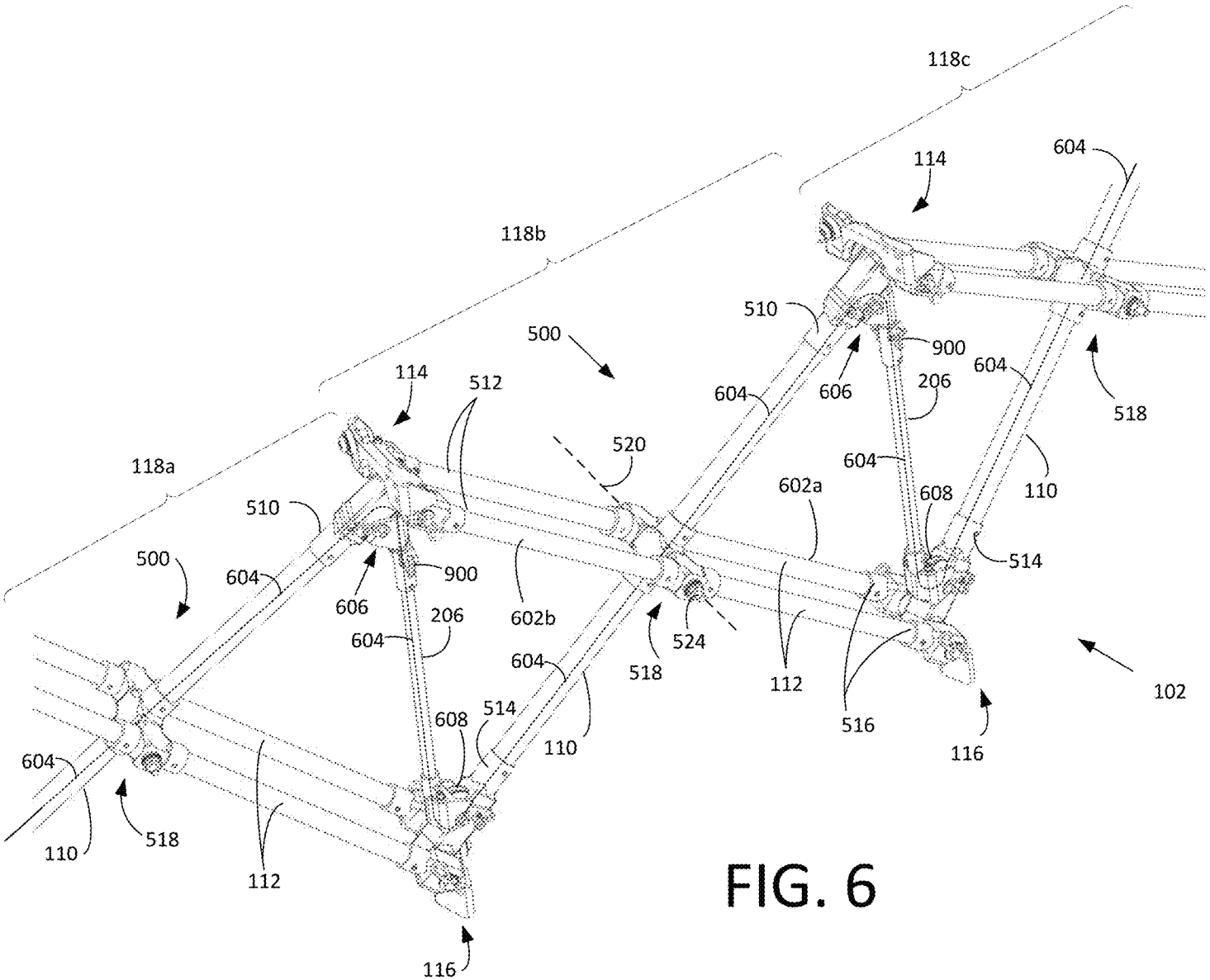
FIG. 6 is a perspective view of a portion of the deployed hoop assembly which is enlarged to show certain details.

The pivot member 518 is configured to facilitate pivot motion of the first link element 110 relative to the second link element 112 about a pivot axis 520 in FIG. 6 when the hoop assembly transitions between the collapsed condition and the expanded condition. As such, the first and second link elements which form the X-member can move in a manner which mimics the operation of a pair of scissors. According to one aspect, the pivot axis 520 of the X-member can be approximately aligned with a radial axis 300 (as shown in FIG. 3) of the larger overall hoop assembly, where the radial axis extends orthogonally from the central axis. The exact configuration of the pivot member 518 is not critical provided that it facilitate the pivot or scissor motion described herein. In some scenarios, the pivot member can be a shaft or an axle 524 on which one or both of the first and second link elements 110, 112 are journaled to facilitate the pivot motion described herein. As such, one or both of the first and second link elements 110, 112 can also include a bearing surface which facilitates rotation of the link member on the pivot member.

The hinge members 114, 116, which are sometimes referred to herein as hinges, are disposed at opposing ends of the first and second link elements 110, 112 and connect adjoining ones of the X-members 500 at the top and bottom corners associated with each side. As shown in FIGS. 5 and 6, the first link element 110 of each X-member 500 is connected at its top end 510 to a second link element 112 of an X-member associated with a first adjacent side. The same first link element 110 is connected at its bottom end 516 to the second link element 112 of a second one of the X-members associated with a second adjacent side. This arrangement allows the ends of each link member to pivot relative to the link elements comprising an adjacent side so that the scissor motion of each X-member as described herein can be facilitated.

As is best shown in FIGS. 5 and 6, the second link element 112 of each X-member 500 is advantageously comprised of a plurality of elongated structural members 602*a*, 602*b*. In some scenarios, this plurality of elongated structural members can extend in parallel with each other as shown. A first one of the elongated structural members 602*a* advantageously extends on an inner side of the first link element 110 which is closest to the central axis 108 of the hoop assembly 102. The second one of the elongated structural members 602*b* can extend on an outer side of the first link element 110 which is furthest from the central axis of the hoop. The pivot member 518 is configured so that it will facilitate pivot motion of each of the plurality of elongated structural members 602*a*, 602*b* relative to the first link element such that the two members can pivot together about the pivot axis 520.

In a scenario disclosed herein, the plurality of elongated structural members 602*a*, 602*b* can be connected to a common or shared hinge 114 at a top end 512 of the second link element 112, and a common or shared hinge 116 at a bottom end 516 of the second link element. As such, the plurality of elongated structural members 602*a*, 602*b* can share a common top hinge 114 and a common bottom hinge 116. As shown in FIG. 6, the common top hinge 114 in a side 118*b* is connected to a top end 510 of the first link element 110 comprising the X-member in a first adjacent side 118*a*. The shared or common bottom hinge 116 is connected to a bottom end 514 of the first link element 110 comprising the X-member in a second adjacent side 118*c*.

Figure 7:
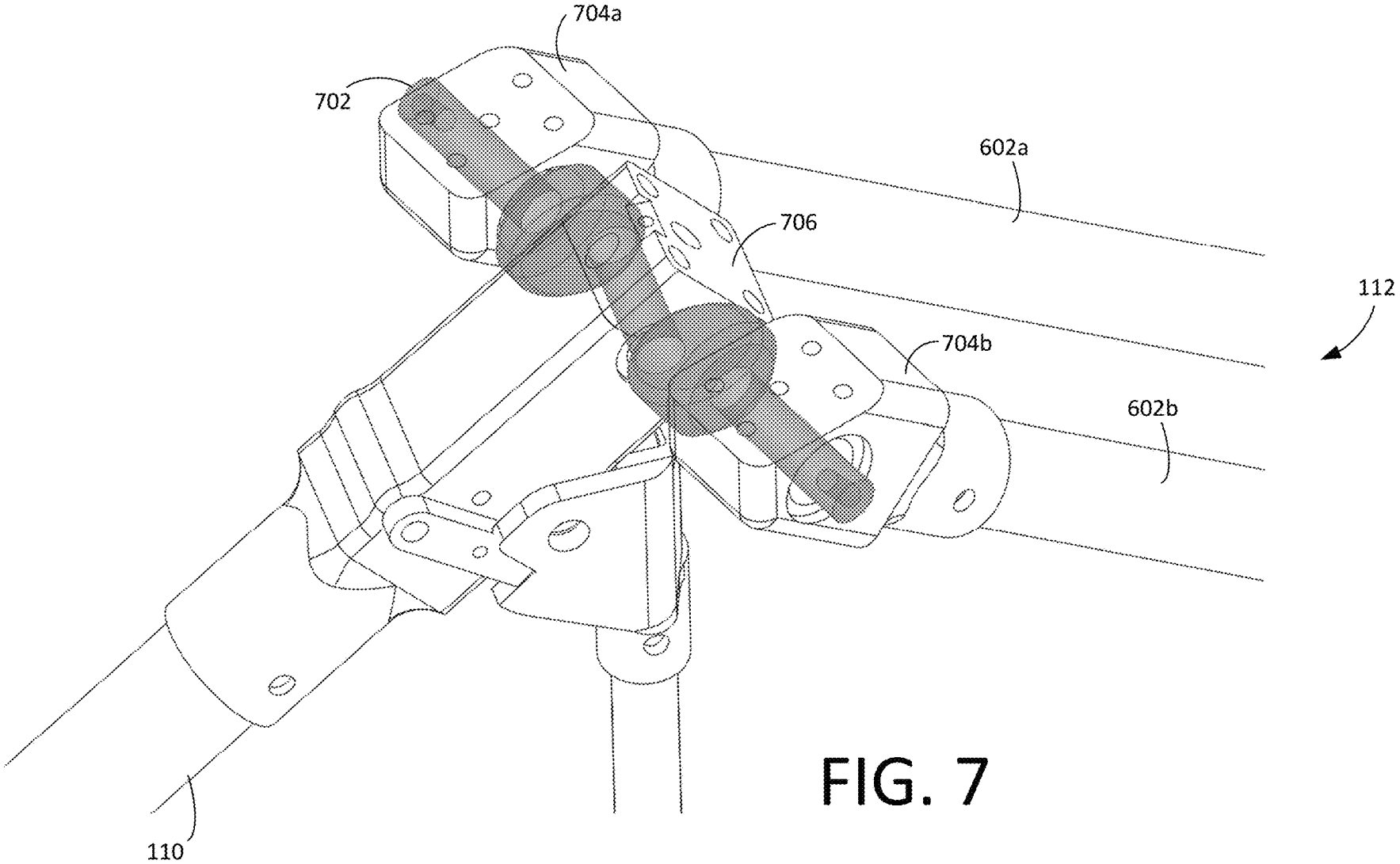
FIG. 7 is a perspective view of a deployed hinge member of the hoop assembly.

In a hoop assembly as described herein adjacent ones of the sides 118 will necessarily be aligned in different planes. This concept is best understood with reference to FIG. 3 which shows that adjacent sides 118 will be aligned in different planes 302*a*, 302*b*. Accordingly, the arrangement of the hinges used to connect the X-members 500 is advantageously selected so as to minimize any potential binding of the hoop assembly 102 during transitions between its stowed condition and deployed condition. Various arrangements for hinge members 114, 116 can be used to facilitate this purpose. One example of a suitable hinge arrangement is shown in greater detail in FIGS. 7 and 8. As illustrated therein the hinge member 114 can comprise an axle shaft 702. Journal bearings 704*a*, 704*b* associated with elongated structural members 602*a*, 602*b* of the second hinge element 112 are journaled on opposing inner and outer shaft end portions 802*a*, 802*c*. Journal bearing 706 associated with first hinge element 110 is journaled on a middle or intermediate shaft portion 802*b* between the first and second opposing shaft end portions.

Figure 8:
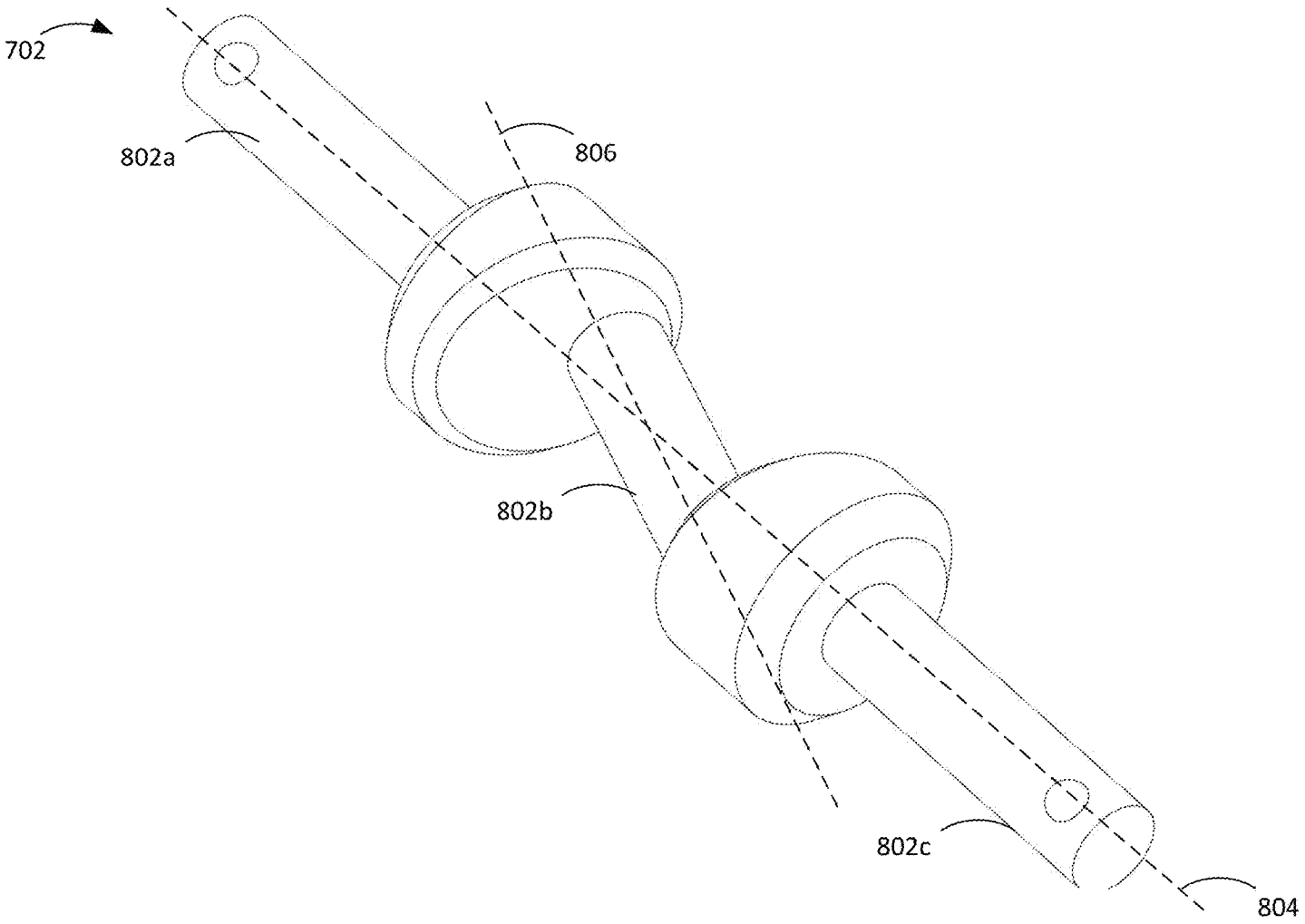
FIG. 8 is a perspective view of a hinge axle shaft.

As best shown in FIG. 8, the axle shaft 702 is angled (i.e., has a non-linear axial extension) so that the inner and outer shaft end portions 802*a*, 802*c* are aligned on a different axis as compared to the intermediate or middle shaft portion 802*b*. For example, in the scenario shown in FIG. 8 the inner and outer shaft end portions 802*a*, 802*b* are aligned on a common axis 804. However, the intermediate shaft portion 802 is aligned along a different axis 806 such that the intermediate shaft portion is axially misaligned with the inner and outer shaft portions. In other words, the intermediate shaft portion extends transversely with respect to the inner and outer shaft portions.

Referencing FIG. 6, the misalignment of the shaft axes as described herein can be useful to permit elongated structural members that comprise a second link element of a first side 118*b* to rotate about a common axis, while also permitting a first link element of an adjacent side 118*a* to rotate about a different axis. This hinge arrangement allows adjacent sides 118*a*, 118*b* to be in different planes, while allowing the elements which comprise the adjacent sides to rotated on the same hinge. Alternative arrangements which can facilitate a similar result include the use of spherical end joints on one or more of the link elements. Such spherical end joints are well-known in the art and are commonly referred to as rod ends or heim joints.

Figure 2:
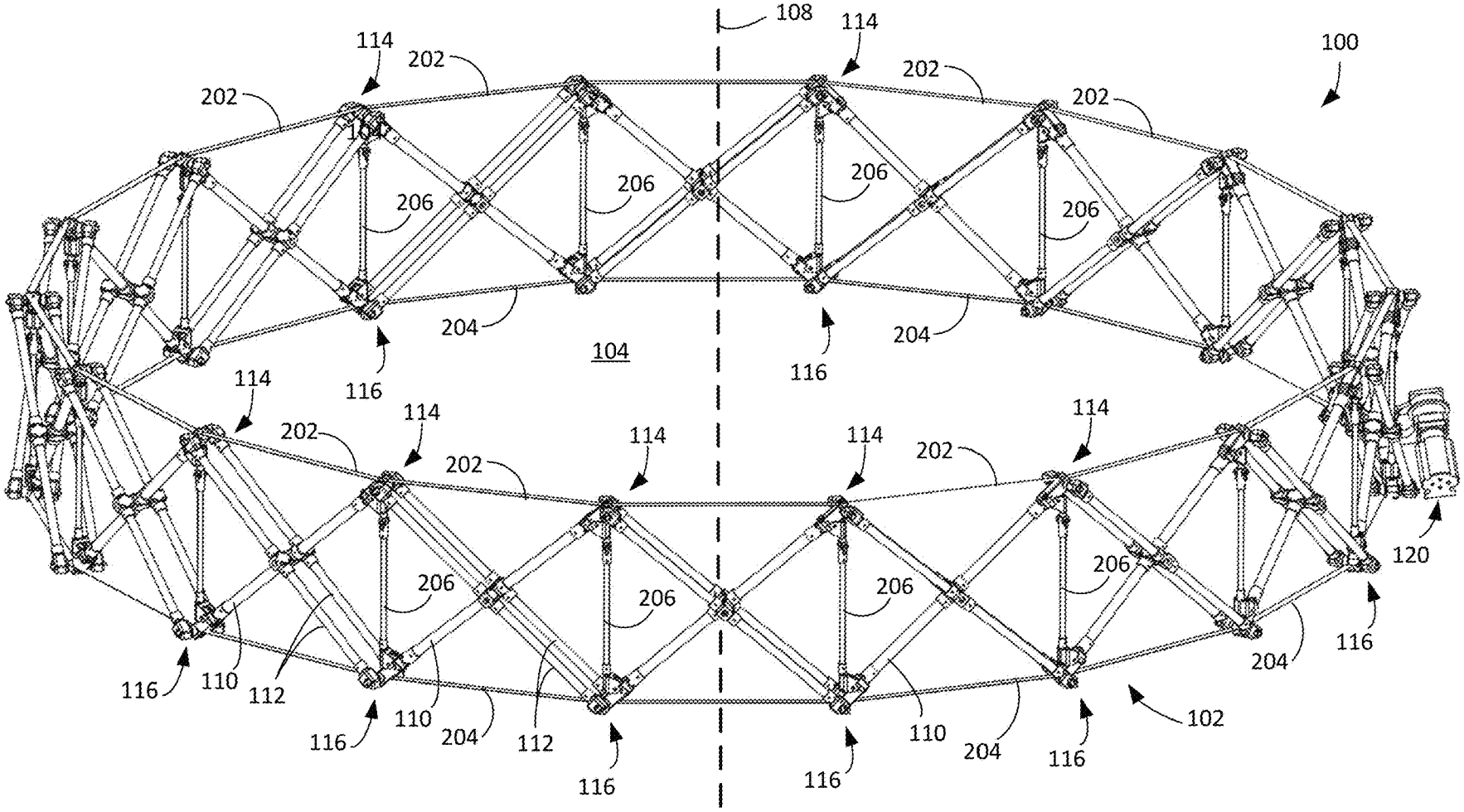
FIG. 2 is a perspective view of the deployed hoop assembly.

Each rectangular side 118 comprising the hoop assembly is further defined by a plurality of tension elements (FIG. 5) which extend around the periphery of the side and apply tension between opposing ends of the first and second link elements in directions aligned with the top, bottom and two opposing edges. More particularly, as shown in FIGS. 2 and 5, the tension elements include a top cord 202 which extends along the top of the side between top ends 510, 512 of the first and second link elements, and a bottom cord 204 which extends along the bottom of the side between bottom ends 514, 516 of the first and second link elements. In a scenario disclosed herein, the top cord 202 is substantially aligned with the top plane defined by the hoop assembly and the bottom cord is substantially aligned with the bottom plane defined by the hoop assembly. In such a scenario, the top cord for each side can be secured to securing hardware (not shown) on opposing ones of the hinge members 114, and the bottom cord for each side can be secured to securing hardware (not shown) on opposing ones of the hinge members 116. The top and bottom cords are tension-only elements, meaning that they are configured exclusively for applying tension between the opposing ends of the link elements. As such the top and bottom cord 202, 204 can be flexible tensile elements, such as cable, rope or tape.

To control the deployed position of each side of the expanded hoop, it is important that the top and bottom cords 202, 204 be stiff elements, meaning that they are highly resistant to elastic deformation when under tension. While slack in the collapsed state, these elements are selected to quickly tension at their expanded length. As such, they act as a 'hard-stop' to limit further hoop expansion by restricting the distance between hinges 114 at the top and 116 at the bottom. To effect 'hard-stop' behavior in these elements, the amount of stretch between the slack state and tension state should be small. For example, assume that the desired length of the top and bottom cord is $L_d$. In such a scenario, each cord will have length $L_d$ when the hoop assembly is in its collapsed condition, with the top and bottom cords 202, 204 folded between the hinges 114, 116 in FIG. 4. In the expanded form length L as in FIG. 5, should be very nearly that same as $L_d$. This can only be achieved if the change in length, $L-L_d$, is small, as will be the case if the element is very stiff (resistant to elastic deformation). So it is advantageous for the cord material to be selected so that the cord stretches very little between the slack state at $L_d$ and the expanded state at L. The degree to which control of the length L is achieved is important in this regard as it helps to maintaina desired position of the hinges 114, 116. This high degree of control over hinge position will in turn facilitate the precision of the attached surface 104 in FIG. 1.

In some scenarios, a separate top cord 202 can be provided between the link elements 110, 112 comprising each side 118. Similarly, each side 118 can be comprised of a separate bottom cord 204 which extends between the bottom ends of the first and second link elements. But in other scenarios it can be advantageous to use a single common top cord 202 which extends in a loop around the entire hoop assembly. Such a top cord 202 can then be secured or tied off at intervals at or near the top ends 510, 512 of the first and second link elements 110, 112. For example, the top cord 202 can be secured at intervals to securing hardware associated with each of the top hinge members 114. Consequently a portion or segment of the overall length of the single common top cord loop will define a top tension element for a particular side. A similar arrangement can be utilized for the bottom cord 204. Since the top and bottom cord have significant stiffness (resistance to elastic deformation) as explained above and are attached to opposing hinge elements at or near the top and bottom of each X-member, their length $L_d$ will necessarily limit the maximum deployed or expanded rotation of the first and second link elements 110, 112 about a pivot axis 524.

Each side 118 is further defined by opposing vertical edge tension elements 206 which extend respectively along the two opposing edges of the side. In a scenario disclosed herein, the edge tension elements 206 can extend respectively along the two opposing vertical edges of each side. The edge tension elements 206 are configured for applying tension between the opposing top and bottom ends of the link elements 512, 514 and 510, 516 when they are in a latched condition.

Referring once again to FIGS. 5 and 6, the hoop assembly also includes at least one deployment cable 604. The deployment cable 604 can be a continuous cord which extends around the perimeter of the hoop assembly 102 to drive transition of the hoop assembly from the collapsed condition to the expanded condition. The deployment cable 604 is a flexible tensile element, such as cable, rope or tape. Portions of the deployment cable 604 extend along the two opposing vertical edges 506, 508 of each side. Under some conditions these portions of the deployment cable can also be understood to function as edge tension elements. More particularly, these portions of the deployment cable 604 will function as the edge tension elements when the edge tension elements 206 are in an unlatched state. In some scenarios, these portions of the deployment cable can be disposed within a central bore of each edge tension element 206 such that the deployment cable 604 and the edge tension element 206 are substantially coaxial.

In each side 118, the control cable extends diagonally between the two opposing edges 506, 508, along the length of the first link element 110. For example, the deployment cable 604 in such scenarios can extend through a bore formed in the first link element 110, where the bore is aligned with the elongated length of the first link element. Of course, other arrangements are also possible and it is not essential that the deployment cable extend through a bore of the first link element. In some scenarios, the control cable could alternatively extend adjacent to the first link element through guide elements (not shown).

Figure 10:
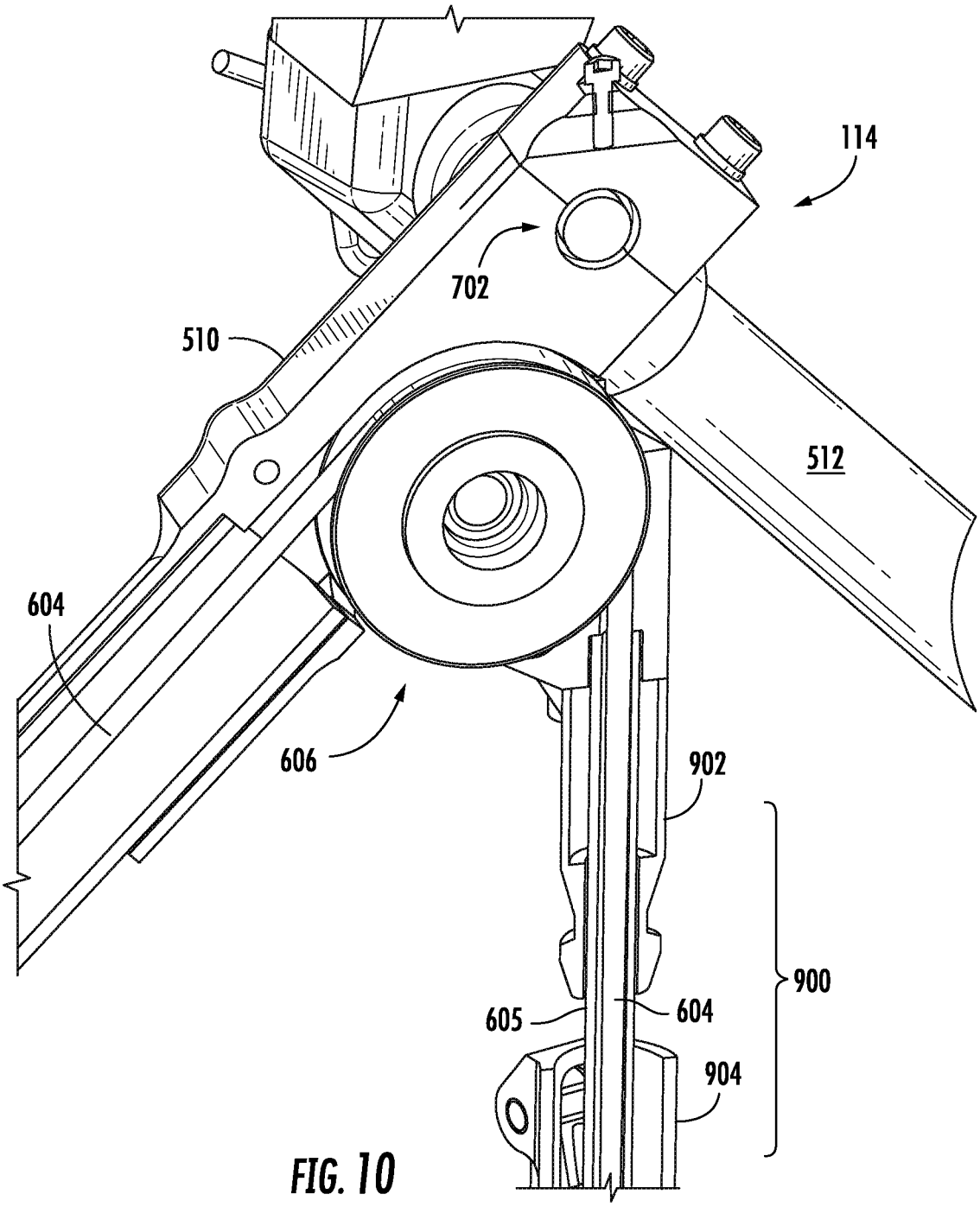
FIG. 10 is a perspective view with hinge member partially cut away to show details of a cord guide system.

Cable guide elements are advantageously provided to transition an alignment of the deployment cable from directions aligned with the opposing edges 506, 508 of each side, to a diagonal direction aligned with the first link element 110. In a scenario disclosed herein, a top guide element 606 and bottom guide element 608 are respectively disposed at the top and bottom ends of the first link element 119. The cable guide elements can be simple structural elements formed of a low friction guiding surface on which the deployment cable can slide. However, it can be advantageous to instead select the cable guide elements to comprise a pulley that is designed to support movement and change of direction of a taught cord or cable. Details of a pulley type of cable guide element 606 can be seen in FIG. 10. Cable guide element 608 can have a similar configuration.

As shown in FIGS. 1-4, a deployment cable actuator 120 can comprise a motor 402 and a drum assembly 404. The deployment cable is wound about the drum, and the motor controls rotation of the drum. In some scenarios, both opposing ends of the deployment cable can be wrapped around the drum to facilitate winding of the cable. With the foregoing arrangement, the length of the deployment cable 604 extending around the perimeter of the hoop assembly (extended length) can be selectively varied by controlling the amount of cord wound about the drum. Decreasing the extended length of the deployment cable around the periphery of the hoop assembly will cause the hoop assembly to transition from a collapsed condition shown in FIG. 4 to an expanded condition shown in FIGS. 1 and 2. More particularly, as an increasing portion of the deployment cable is wound on the drum, the extended length of the cord will necessarily shorten and the opposing edges 506, 508 of each side 118 forming the hoop assembly will decrease in length. The foregoing action will result in expanding the radius of the hoop assembly until it reaches its deployed condition.

Substantial deployment cable tension force can be required in order to expand the hoop assembly to its fully deployed condition. However, a reflector antenna as described herein can remain deployed for long periods of time. Consequently, it can be desirable to provide at least one latching element which is configured to latch the X-members 500 in a fixed pivot or scissor position after the hoop assembly is in the expanded condition. The latch assembly can be configured to allow a force applied by the deployment cable to be reduced while maintaining the hoop assembly in the expanded condition.

In a scenario disclosed herein, the referenced latch assembly can be incorporated into the edge tension elements 206. Such a scenario is shown in FIGS. 9A-9C, and FIG. 10 which includes latch assembly 900. The latch assembly 900 includes upper and lower latch members 902, 904. A cord shroud 605 is disposed coaxially within the upper and lower latch members 902, 904 to help guide the cord within the latch members. As the extended length of control cable 604 is reduced by winding the deployment cable 604 around the drum assembly 404, the upper and lower latch members are caused to move in directions indicated by arrows 906, 908 as the length of each side 506, 508 is decreased. When the hoop assembly is in this condition (with the latch assembly in an unlatched state), the portions of the deployment cable 604 extending along the side of each rectangular side can be understood to be functioning as the edge tension elements.

Figure 9A:
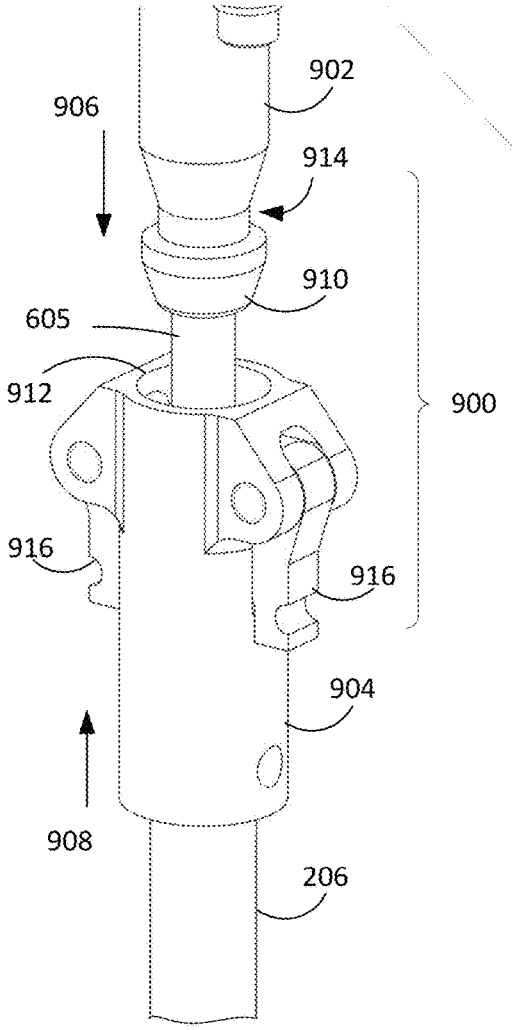
FIGS. 9A-9C are three related views of a deploying latch assembly which is enlarged to show certain details.
Figure 9B:
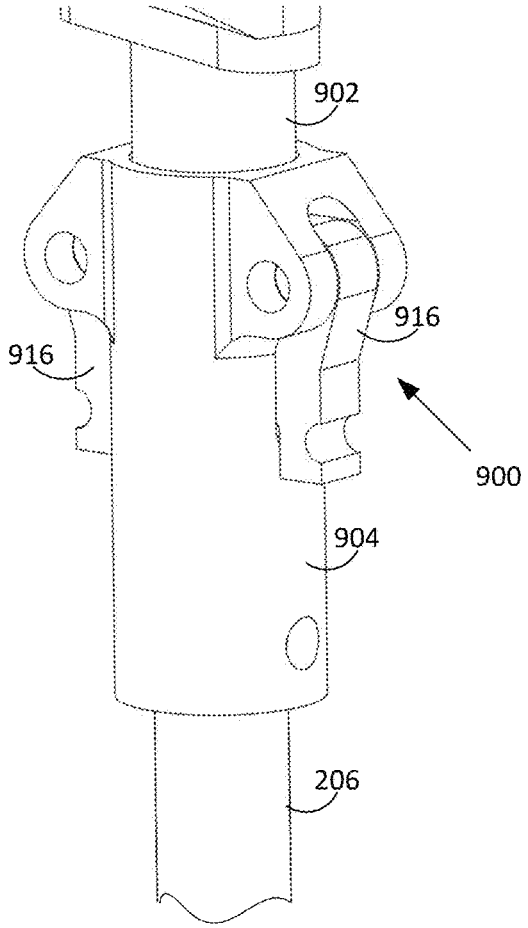
Figure 9C:
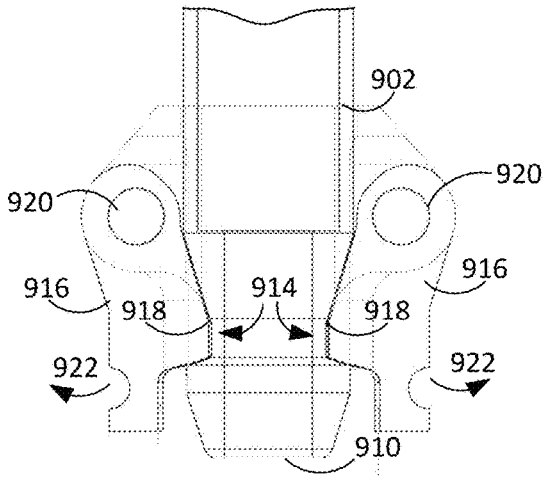

Eventually, a tip end 910 of the upper latch member 902 will be guided into a latch receptacle 912 of the lower latch member 904. The latch receptacle 912 in this example is a bore formed in an end portion of the lower latch member 904. The upper and lower latch members will then continue moving in directions 906, 908 until a notch 914 formed in the upper latch member is engaged by a nub 918 associated with a latching wings 916. In FIGS. 9A and 9B, a pair of such latching wings are provided for this purpose. The latching wings can rotate in directions 922 about pivot guide elements 920 to accommodate the upper latch member 902 as it is inserted into the lower latch member 904. The latching wings then return to a position shown in FIG. 9C when the nubs are seated in the notch 914. At this point the latch 900 is in its latched condition shown in FIGS. 9B and 9C and the upper latch members 902 will be prevented from being disengaged from the lower latch member 904. In some scenarios, the latching wings can be resiliently biased so that the nubs 918 are retained in the notch 914.

Once the latch 900 is engaged, the tension force exerted by the deployment cable 604 on the first and second link elements 110, 112 can be removed. The tension force previously provided by the deployment cable 604 will be instead maintained by the side tension elements 206 since the edge tension elements 206 will have been transitioned to their latched condition. The hoop assembly 102 can then remain in the expanded condition, with the latches 900 engaged.

As the antenna structure deploys, the nominal tension in the deployment cable 604 is virtually zero as there are no resistive forces acting upon the structure. More particularly, there are no inwardly directed radial forces at hinges 114, 116 tending to push the structure towards its stowed position. Thus, as the structure deploys there is nothing to prevent the structure advancing more than the deployment cable windup would require. Due to the linked behavior of the collective set of X-members 500 the structure is synchronized. However, absent some type of biasing or limiting arrangement, the radius of the hoop assembly is possibly uncontrolled. Practically speaking, this means that if the deployment cable is lagging the structure position, there exists the possibility the extra slack in the deployment cable could allow disengagement of the cable from its pulleys. So it is advantageous that some minimal level of load be maintained on the deployment cable to preclude it ever becoming slack during the deployment.

To provide a mechanism to maintain deployment cable tension at all stages of deployment, the antenna system advantageously includes a resistance device that is configured to facilitate radially directed inward forces at hinges 114, 116 and or pivot members 518. In some scenarios, this can be implemented with a resistance cable that circumscribes the hoop assembly and is attached to all of the hinge elements 114, 116 and/or pivot members 518. This resistance cable is initially wound around a drum (not shown) in a similar fashion to the deployment cable 604 and is controlled in a fashion to maintain a prescribed level of tension on the deployment cable. The foregoing result is accomplished by letting the resistance cable out from the drum at a rate consistent with the deployment cable take-up rate. In this manner, the forces imposed by the resistance cable are reacted by the deployment cable, thereby maintaining the deployment cable at a prescribed minimal load to prevent the deployment cable from disengaging the pulleys.

In a scenario shown in FIG. 5, a single resistance cable 522 is provided as described herein. The resistance cable is secured to the pivot members 518. Alternatively, multiple circumferential cables secured respectively at hinges 114 and 116 could be implemented. However it is anticipated that additional cables disposed at hinges 114, 116 will add complexity that is not required.

A further significant benefit of the resistance cable described herein is that it can serve as a re-stow cable to facilitate ground operations. Operation on-orbit usually does not require a full re-stow, as in most scenarios only a single deployment is required. However, partial re-stow on-orbit is an attractive feature to aid in over-coming anomalous conditions.

Of course other configurations for adding resistance to the antenna system during the deployment process are also possible and contemplated within the scope of the invention. For example, another method to implement the resistance function described herein can involve friction inducing devices that can be implemented in all or a subset of the hinges 114, 116 and/or pivot members 518. Friction inducing members associated with hinge or pivot elements are well-known in the art and therefore will not be described in detail. The friction inducing members as described are a passive mechanism available to maintain the deployment cable in tension and has the possible benefit of being a simpler approach in some scenarios. However it will be appreciated that the passive friction members described herein do not provide for any re-stow capability.

Finally, it may be noted that as the deployment of the antenna system progresses to the point where the surface 104 (FIG. 1) begins to tension at near full deployment, the surface tension will provide significant radially inward directed forces that must be reacted by the deployment cable and particularly by the tension of the deployment cable 604 in the vertical edges. To maintain the surface in a tensioned state these edge verticals are essential and are loaded to a significant degree. This required tension facilitates the latching process that allows the cable to be relaxed once the latching elements of 900 activate.

Reference throughout this specification to features, advantages, or similar language does not imply that all features and advantages that may be realized should be or are in any single embodiment. Rather, language referring to the features and advantages is understood to mean that a specific feature, advantage, or characteristic described in connection with a particular implementation is included in at least one embodiment. Thus, discussions of the features and advantages, and similar language, throughout the specification may, but do not necessarily, refer to the same embodiment.

Furthermore, the described features, advantages and characteristics disclosed herein may be combined in any suitable manner. One skilled in the relevant art will recognize, in light of the description herein, that the disclosed systems and/or methods can be practiced without one or more of the specific features. In other instances, additional features and advantages may be recognized in certain scenarios that may not be present in all instances.

Reference throughout this specification to "one embodiment", "an embodiment", or similar language means that a particular feature, structure, or characteristic described in connection with the indicated embodiment is included in at least one embodiment. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the systems and methods have been illustrated and described with respect to one or more implementations, equivalent alterations and modifications will occur to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application. Thus, the breadth and scope of the disclosure herein should not be limited by any of the above descriptions. Rather, the scope of the invention should be defined in accordance with the following claims and their equivalents.

We claim:

1. A reflector antenna system, comprising:

a hoop assembly comprising a plurality of link elements which are rigid and extend between a plurality of hinge members, the hoop assembly configured to expand between a collapsed condition wherein the link elements extend substantially parallel to one another and an expanded condition wherein the link elements define a circumferential hoop around a central axis;

a reflector surface comprised of a collapsible web and secured to the hoop assembly such that when the hoop assembly is in the expanded condition, the reflector surface is expanded to a shape that is configured to concentrate RF energy in a desired pattern;

wherein the hoop assembly in the expanded condition is defined by a plurality of N sides, each defining a rectangle, including a top, a bottom, and two opposing edges aligned with the central axis, said N sides disposed edge to edge circumferentially around a periphery of the hoop assembly whereby each opposing edge extends substantially the full axial depth of the hoop assembly in a direction aligned with the hoop central axis; and wherein each of the N sides is comprised of an X-member comprised of a plurality of the link elements including a first and a second link element respectively disposed on opposing diagonals of the rectangle in a crossed configuration, and a pivot member connected at a medial pivot point of the first and second link elements, the pivot member facilitating pivot motion of the first link element relative to the second link element on a pivot axis when the hoop assembly transitions between the collapsed condition and the expanded condition;

at least one top cord which extends along the top of the side between top ends of the first and second link elements, at least one bottom cord which extends along the bottom of the side between bottom ends of the first and second link elements; and first and second edge tension elements which extend respectively along the two opposing edges of the side; and at least one deployment cable to provide a force needed to transition the hoop assembly from the collapsed condition to the expanded condition by reducing a length of each opposing edge.

2. The reflector antenna system according to claim 1, wherein each of the first and second link elements include a top end which extends to a top corner of the rectangle defined by the side, and a bottom end which extends to a bottom corner of the rectangle defined by the side.

3. The reflector antenna system according to claim 2, wherein the hinge members connect adjoining ones of the X-members associated with adjacent sides at the top and bottom corners associated with each edge.

4. The reflector antenna system according to claim 2, wherein the first link element of each X-member is connected at the top end to the second link element of a first one of the X-members associated with a first adjacent side, and at a bottom end to the second link element of a second one of the X-members associated with a second adjacent side.

5. The reflector antenna system according to claim 1, wherein the second link element is comprised of a plurality of elongated structural members which extend in parallel respectively on an inner and outer side of the first link element.

6. The reflector antenna system according to claim 5, wherein the pivot member pivotally connects each of the plurality of elongated structural members to the first link element.

7. The reflector antenna system according to claim 5, wherein the plurality of elongated structural members which comprise the second link element are connected to a top hinge at a top end of the second link element, and connected to a bottom hinge at a bottom end of the second link element.

8. The reflector antenna system according to claim 7, wherein the top hinge is connected to a top end of the first link element comprising the X-member in a first adjacent side, and the bottom hinge is connected to a bottom end of the first link element comprising the X-member in a second adjacent side.

9. The reflector antenna system according to claim 1, wherein each of the top cord and the bottom cord are exclusively tension elements.

10. The reflector antenna system according to claim 1, wherein the deployment cable extends along a length of each of the edge tension elements, and diagonally along the length of the first link element of the side.

11. The reflector antenna system according to claim 10, further comprising top and bottom cord guide elements respectively disposed at the top and bottom ends of the first link element, the top and bottom cord guide elements configured to transition an alignment of the deployment cable from directions aligned with the opposing edges of each side, to a diagonal direction aligned with the first link element.

12. The reflector antenna system according to claim 10, further comprising at least one actuator configured to vary a length of the opposing edges of the side by controlling an extended length of the deployment cable extending around a periphery of the hoop assembly.

13. The reflector antenna system according to claim 1, further comprising at least one latching element configured to latch the X-members in a fixed pivot position after the hoop assembly is in the expanded condition, whereby a force applied to the first link element by the deployment cable can be reduced while maintaining the hoop assembly in the expanded condition.

14. The reflector antenna system according to claim 1, further comprising a resistance mechanism configured to resist the transition of the hoop assembly from the collapsed condition to the expanded condition.

15. A reflector antenna system, comprising:

a hoop assembly comprising a plurality of link elements which are rigid and extend between a plurality of hinge members, the hoop assembly configured to expand between a collapsed condition wherein the link elements extend substantially parallel to one another and an expanded condition wherein the link elements define a circumferential hoop around a central axis;

a reflector comprised of a flexible web material secured to the hoop assembly such that when the hoop assembly is in the expanded condition, the flexible web material is expanded to a shape that is configured to concentrate RF energy in a desired pattern;

wherein the hoop assembly in the expanded condition defines a plurality of N rectangular sides, each of which includes a top, a bottom, and two opposing edges aligned with the central axis, the rectangular sides disposed side to side circumferentially around a periphery of the hoop assembly, and each opposing edge substantially extending the full axial depth of the hoop assembly in a direction aligned with the hoop central axis; and wherein each of the N rectangular sides is comprised of an X-member comprised of a plurality of the link elements including a first and a second link element which respectively extend substantially between opposing top and bottom corners of the rectangular side in a crossed configuration; and a plurality of tension elements which extend around the periphery of the side and apply tension between opposing ends of the first and second link elements in directions aligned with the top, bottom and two opposing edges.

16. The reflector antenna system according to claim 15, wherein the hinge members connect adjoining ones of the X-members associated with adjacent sides at the top and bottom corners of each rectangular side.

17. The reflector antenna system according to claim 15, wherein the second link element is comprised of a plurality of elongated rigid structural members which respectively extend in parallel on an inner and outer side of the first link element.

18. The reflector antenna system according to claim 15, further comprising a pivot member which is connected to the first and second link elements, the pivot member facilitating pivot motion of the first link element relative to the second link element on a pivot axis when the hoop assembly transitions between the collapsed condition and the expanded condition.

19. The reflector antenna system according to claim 18, wherein the plurality of tension elements include first and second edge tension cords which are also deployment cables configured to transition the hoop assembly from the collapsed condition to the expanded condition by reducing a length of the two opposing edges associated with each rectangular side.

20. The reflector antenna system according to claim 19, further comprising at least one latching element configured to latch the X-members in a fixed pivot position after the hoop assembly is in the expanded condition.

21. The reflector antenna system according to claim 20, wherein the plurality of tension elements include a top cord which extends along a top of the rectangular side and a bottom cord which extends along a bottom of the rectangular side.

22. A reflector antenna system, comprising:

a hoop assembly comprising a plurality of link elements which are rigid and extend between a plurality of hinge members, the hoop assembly configured to expand between a collapsed condition wherein the link elements extend substantially parallel to one another and an expanded condition wherein the link elements define a circumferential hoop around a central axis;

a reflector surface comprised of a collapsible web and secured to the hoop assembly such that when the hoop assembly is in the expanded condition, the reflector surface is expanded to a shape that is configured to concentrate RF energy in a desired pattern;

wherein the hoop assembly in the expanded condition defines a plurality of N rectangular sides, each of which includes a top, a bottom, and two opposing edges aligned with a central axis of the hoop assembly, the rectangular sides disposed circumferentially side to side around a periphery of the hoop assembly; and wherein each of the N rectangular sides is comprised of an X-member comprised of a plurality of the link elements including a first and a second link element which respectively extend substantially between opposing top and bottom corners of the rectangular side in a crossed configuration;

a top tension cord which extends along the top of the rectangular side between top ends of the first and second link elements, and a bottom tension cord which extends along the bottom of the rectangular side between bottom ends of the first and second link elements; and a first side tension element which extends along a first one of the opposing edges of the rectangular side between a top end of the first link element and a bottom end of the second link element, and a second edge tension element which extends along a second one of the opposing sides of the rectangular side between a bottom end of the first link element and a top end of the second link element.

23. The reflector antenna according to claim 22, wherein the top tension cord is substantially aligned with a top plane of the hoop assembly and the bottom tension cord is substantially aligned with a bottom plane of the hoop assembly.

* * * * *